US005283590A

United States Patent [19]

Wong

[11] Patent Number: 5,283,590

[45] Date of Patent: Feb. 1, 1994

[54] ANTENNA BEAM SHAPING BY MEANS OF PHYSICAL ROTATION OF CIRCULARLY POLARIZED RADIATORS

[75] Inventor: Gary G. Wong, Torrance, Calif.

[73] Assignee: TRW Inc., Redondo Beach, Calif.

[21] Appl. No.: 864,250

[22] Filed: Apr. 6, 1992

[51] Int. Cl.[5] ..... H01Q 19/06

[52] U.S. Cl. ..... 343/754; 343/757; 343/821

[58] Field of Search ..... 343/754, 700 MS File, 343/757, 845, 846, 793, 755, 758, 761, 821, 895; H01Q 19/06

[56] References Cited

U.S. PATENT DOCUMENTS

| | | | |
|---|---|---|---|
| 3,045,237 | 7/1962 | Marston | 343/754 |
| 3,445,850 | 5/1969 | Stegen | 343/754 |
| 3,524,188 | 8/1970 | Bowman | 343/754 |
| 4,684,952 | 8/1987 | Munson et al. | 343/754 |
| 4,905,014 | 2/1990 | Gonzalez et al. | 343/754 |

OTHER PUBLICATIONS

C. C. Chen & Taro Yodokawa, "A Canonical Phasing Technique for Phase Compensation of Circularly Polarized Array Antennas", 1976 AP-S International Symposium, pp. 149-152.

*Primary Examiner*—Donald Hajec
*Assistant Examiner*—Hoanganh Le
*Attorney, Agent, or Firm*—Ronald L. Taylor

[57] ABSTRACT

Disclosed is an apparatus and method for shaping a beam of radiation from a circularly polarized beam shaping antenna to create a predetermined radiation pattern. A circularly polarized feed horn generates the beam of radiation to be shaped. Circularly polarized radiator elements attached to a ground plane are positioned to receive the beam of radiation. Each radiator element is physically rotated about an axis relative to the ground plane to alter its phase. The radiator elements are then operable to individually radiate a beam of radiation to form a combined radiation beam creating the predetermined radiation pattern.

10 Claims, 2 Drawing Sheets

ANTENNA BEAM SHAPING BY MEANS OF PHYSICAL ROTATION OF CIRCULARLY POLARIZED RADIATORS

BACKGROUND OF THE INVENTION

1. Technical Field

This invention relates generally to a circularly polarized beam shaping antenna, and more particularly, to a device for shaping a beam of radiation to create a predetermined radiation pattern by physical rotation of circularly polarized radiator elements on a ground plane of the antenna.

2. Discussion Of The Related Art

In order to avoid interference of one radio system upon another, and to control the area where electromagnetic energy from these systems are radiated, transmitting antennas are known which direct electromagnetic energy in a predetermined radiation pattern. The shape of the radiation pattern is generally dependent on the type of antenna used and the beam shaping technique employed. Currently, there are several different antennas and beam shaping techniques known to shape the radiation pattern, including: (1) aperture shaping techniques; (2) beam shaping with a shaped surface reflector antenna; (3) array fed parabolic reflector antennas; and (4) microstrip reflectarrays.

In the aperture shaping technique, the aperture shape of a feed horn or of a focused reflector surface is modified to achieve the desired radiation pattern. For example, an elongated shaped aperture will produce an elongated beam, an elliptical shaped aperture will produce an elliptical beam, etc. However, this technique is limited to simple geometric shapes, whereas many designs require various irregular and/or complex shapes.

Beam shaping with a shaped surface reflector antenna consist of a single feed horn illuminating an irregularly contoured reflector surface. Coherent circularly polarized electromagnetic energy is radiated from the feed horn to the irregularly contoured reflector surface. The path length from the feed horn to the reflector surface alters the phase of the corresponding reflected beams. The combined radiation beam from the various phase reflected beams create the desired radiation pattern. This technique is suitable for numerous desired radiation pattern shapes, but is difficult and expensive to construct, since the reflector surface must be machined to the required contour. Additionally, shaped surface reflector antennas are limited to a single radiation pattern. Moreover, the phase relationship between adjacent points on the reflector surface often creates discontinuities in the reflector surface. Therefore, the phase difference between adjacent points on the reflector surface is typically limited to less than 90°. This inhibits a step type surface from being created which generate the discontinuities and poses a difficult machining process.

In an array fed parabolic reflector antenna, multiple feed horns generally illuminate a parabolic reflector. The combined radiation beam from each feed horn, adjusted with the right phase and amplitude, produces the desired radiation pattern. This technique suffers from several drawbacks including RF loss, decrease in antenna gain, control problems, cost and complexity, thereby making its use less attractive.

The microstrip reflectarray antenna consist of radiator elements arranged on a planar aperture. The radiator elements are connected to short circuit terminations and are illuminated by a feed horn. When illuminated, these radiator elements will re-radiate their illuminated electromagnetic energy back into space. To control the radiation pattern, the path lengths from the feed horn to the short circuit terminations are controlled, which in turn, control the phase of the re-radiated beams. Transmission lines of different lengths are connected between the radiator elements and the short circuit terminations to alter the path lengths and phase of the re-radiated beams. The disadvantages of this antenna are its very stringent design tolerances and a rigorous analytical technique to accurately control and model the radiation pattern.

The current antennas and techniques described, each shape a predetermined radiation pattern. However, each antenna and technique have disadvantages that affect their cost, complexity and feasibility. What is needed then, is a beam shaping antenna for radiating a predetermined radiation pattern which is cost efficient, easily manufactured, capable of radiating complex, irregularly shaped radiation patterns, not limited to a single radiation pattern or phase adjustment, maintains good antenna gain and has wider tolerance requirements. It is therefore an object of the present invention to provide such a device.

SUMMARY OF THE INVENTION

In accordance with the present invention, a predetermined electromagnetic radiation pattern is created by shaping a beam of radiation from a circularly polarized beam shaping antenna. This is basically achieved by physical rotation of circularly polarized radiator elements on a ground plane, wherein the rotation alters the phase of each radiator element such that the combined radiation from each individual radiator element shapes a combined beam to create a predetermined radiation pattern.

In one preferred embodiment, a circularly polarized feed horn generates the beam of radiation to be shaped. A number of circularly polarized radiator elements attached to a ground plane and connected to short circuit terminations by transmission lines are positioned to receive the radiated beam. The radiator elements are rotated relative to the ground plane, thereby altering the phase of each element. Each element individually radiates a beam to form the combined radiation beam which creates the predetermined radiation pattern.

In another preferred embodiment, the circularly polarized feed horn again generates the beam of radiation to be shaped. The circularly polarized radiator elements are attached to a first ground plane and are positioned to receive the radiated beam. Each radiator element is further connected in conjugate pairs to radiator elements attached to a second ground plane by transmission lines. The radiator elements on the second ground plane are rotated relative to the ground plane, thereby altering the phase of each element. Each element attached to the second ground plane individually radiates a beam to form the combined radiation beam creating the predetermined radiation pattern. This radiation pattern propagates through space in the same direction as the feed horn radiation pattern.

The present invention provides a circularly polarized beam shaping antenna which is capable of radiating complex, irregularly shaped radiation patterns in a cost efficient, easily manufactured way. The pattern characteristic can be limited to a single radiation pattern or multiple patterns. Furthermore, the antenna is capable of good antenna gain with wide tolerance requirements. As a result, the aforementioned problems associated with currently available beam shaping antennas and techniques should be substantially eliminated.

BRIEF DESCRIPTION OF THE DRAWINGS

Still other advantages of the present invention will become apparent to those skilled in the art after reading the following specifications and by reference to the drawings in which.

DETAILED DESCRIPTION OF THE PREFERRED EMBODIMENT

The following description of the preferred embodiments concerning circularly polarized beam shaping antennas is merely exemplary in nature and is in no way intended to limit the invention or its application or uses.

Figure 1:
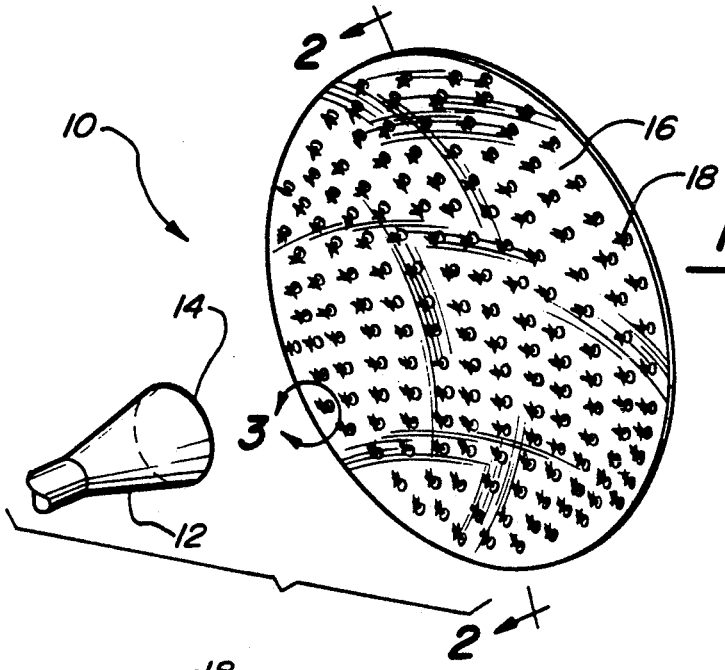
FIG. 1 is a perspective view of one preferred embodiment of the subject invention containing a number of circularly polarized crossed dipole radiator elements attached to the concave surface of a parabolic ground plane having a circular circumference and a conical feed horn.

Referring to FIG. 1, a perspective view of a circularly polarized beam shaping antenna 10, according to one preferred embodiment of the present invention, is shown. The circularly polarized beam shaping antenna 10 includes a circularly polarized conical feed horn 12 having a circular aperture 14. Conical feed horn 12 is preferably located at the focal point of a parabolic ground plane 16 having a circular circumference. The location of the conical feed horn 12 provides a −10 db edge taper at the edge of the ground plane 16. One skilled in the art would further recognize that the ground plane 16 can also include other surface contours, sizes and circumferences, depending on the design constraints and parameters desired. Moreover, the ground plane 16 is preferably constructed of an electrically conductive aluminum alloy material. However, the ground plane 16 can also be constructed of other electrically conductive materials such as various alloys, graphite or conductive mesh.

The conical feed horn 12 generates a circularly polarized beam of radiation (not shown). This beam of radiation illuminates a series of circularly polarized crossed dipole radiator elements 18, attached to the parabolic ground plane 16. One skilled in the art would also find it apparent that the conical feed horn 12 can consist of any type of feed horn capable of generating a circularly polarized beam of radiation. This circularly polarized beam of radiation includes an electric field which rotates about the direction of propagation so that the electric field from the beam makes one full rotation for each wavelength it advances. Furthermore, the frequency and amplitude of the circularly polarized beam as well as the path length from the conical feed horn 12 to the crossed dipole radiator elements 18 will vary depending on the design constraints and parameters desired.

Figure 2:
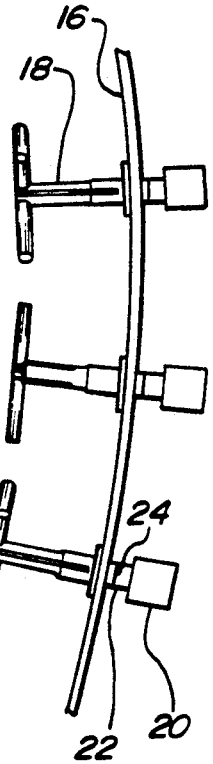
FIG. 2 is an enlarged cross-sectional side view of the embodiment of FIG. 1 taken along the lines 2—2 of FIG. 1 displaying the crossed dipole radiator elements attached to the parabolic ground plane and connected to short circuit terminations by transmission lines.

Referring to FIG. 2, a side view of the crossed dipole radiator elements 18, attached to the parabolic ground plane 16, is shown. Crossed dipole radiator elements 18 are connected to short circuit terminations 20 by transmission lines 22. Transmission lines 22 are preferably high frequency semi-rigid coaxial cables having inner and outer conductors. Alternatively, transmission lines 22 can consist of any type of transmission line capable of transmitting high frequency electrical signals. The short circuit terminations 20 join the inner and outer conductors of transmission lines 22, thereby making the conductors common. The radiator elements 18, transmission lines 22 and short circuit terminations 20 are operable to receive and re-radiate the circularly polarized beam of radiation. Crossed dipole radiator elements 18 also include slip joints 24 which accommodate the rotation of crossed dipole radiator elements 18 relative to the ground plane 16. Slip joints 24 can also be substituted by other rotational mechanisms to enable rotation of the crossed dipole radiator elements 18.

Figure 3:
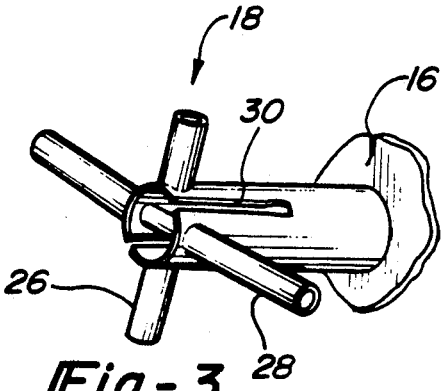
FIG. 3 is an enlarged perspective view taken about line 3 of FIG. 1 of a crossed dipole radiator element.

Referring to FIG. 3, each of the crossed dipole radiator elements 18 consist of a dipole arm 26 extending perpendicular to a dipole arm 28 having a split balun 30. The diameter of the dipole arms 26 and 28 control the bandwidth of the radiated beam, while the length of the dipole arms 26 and 28 control the frequency of the radiated beam. The unequal lengths of the crossed dipole arms 26 and 28 in conjunction with opposite polarities on either side of the split balun 30, produces the circular polarization. The crossed dipole radiator elements 18 are preferably constructed of a conductive graphite material. However, crossed dipole radiator elements 18 can also be constructed of various other conductive materials, including aluminum and metal alloys.

In operation, the conical feed horn 12 generates the circularly polarized beam of radiation which is received by the crossed dipole radiator elements 18. The circularly polarized beam impinges the crossed dipole radiator elements 18 and propagates through the transmission lines 2 to the short circuit terminations 20. The transmission lines 22 act as waveguides which support propagation of the radiated beam received by crossed dipole radiator elements 18. After propagating through the transmission lines 22, and arriving at the short circuit terminations 20, the circularly polarized beams are reflected back such that the beams propagate through transmission lines 22 and out the crossed dipole radiator elements 18. This causes each crossed dipole radiator element 18 to radiate an individual circularly polarized beam of radiation having the same polarization as the incident beam from the feed horn.

The phase of the individual beams radiated from each crossed dipole radiator element 18 is altered by the physical rotation of the crossed dipole radiator elements 18, relative to the ground plane 16, employing slip joints 24. For example, if the crossed dipole radiator element 18 is rotated clockwise +45°; (as viewed from the front of the crossed dipole radiator element 18) the phase of the radiated beam from the crossed dipole radiator element 18 will lead by +45°. Conversely, if the crossed dipole radiator element 18 is physically rotated counterclockwise −45°, the radiated beam will lag by −45°. The individual radiation from each crossed dipole radiator element 18 thus forms a combined radiation beam in the far field creating a predetermined radiation pattern. This radiation pattern may cover a particular portion of a state, country or continent and selectively exclude various other areas.

Figure 4:
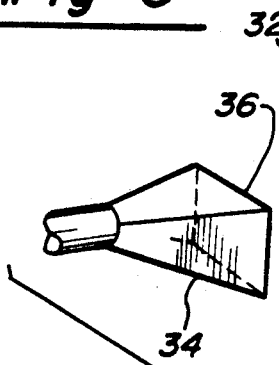
FIG. 4 is a perspective view of another preferred embodiment of the subject invention containing a number of circularly polarized crossed dipole radiator elements attached to a first planar ground plane and a second planar ground plane having elliptical circumferences and a pyramidal feed horn.
Figure 4:
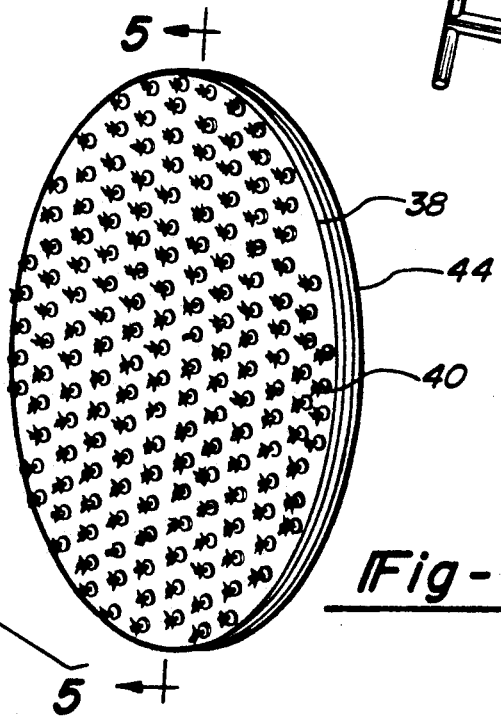
Figure 5:
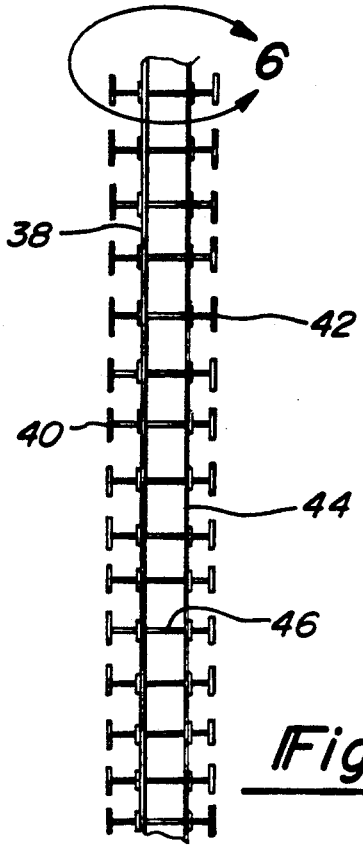
FIG. 5 is a cross-sectional side view of the embodiment of FIG. 4 taken along the lines 5—5 of FIG. 4.
Figure 6:
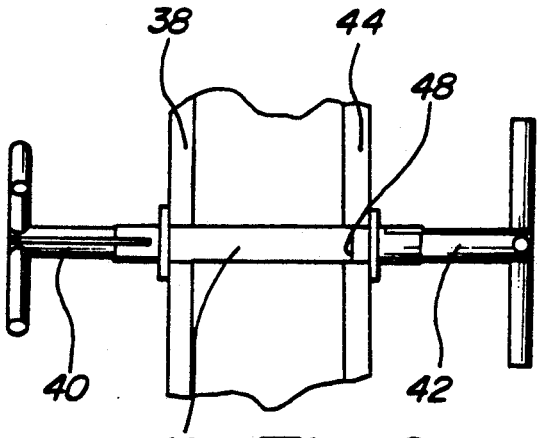
FIG. 6 is an enlarged cross-sectional side view of FIG. 5 taken about line 6, displaying a pair of crossed dipole radiator elements attached to the first planar ground plane and the second planar ground plane and connected by a transmission line.

Referring to FIGS. 4–6, another preferred embodiment of a circularly polarized beam shaping antenna 32, is shown. Circularly polarized beam shaping antenna 32 includes a circularly polarized pyramidal feed horn 34 having a rectangular aperture 36. The pyramidal feed horn 34 is preferably located at the focal point of a first planar ground plane 38. The pyramidal feed horn 34 generates the circularly polarized beam of radiation. This beam of radiation illuminates a series of circularly polarized crossed dipole radiator elements 40, attached to the elliptically shaped first planar ground plane 38. The crossed dipole radiator elements 40 are operable to receive the circularly polarized beam of radiation.

A number of crossed dipole radiator elements 42 are attached to a second planer ground plane 44, also having an elliptical circumference. Ground plane 44 is positioned opposite to the feed horn 34 such that it is substantially aligned with the first planar ground plane 38. The crossed dipole radiator elements 40, are connected in conjugate pairs to the crossed dipole radiator elements 42, by means of a series of transmission lines 46, shown more clearly in FIGS. 5 and 6. Crossed dipole radiator elements 42 are operable to radiate the circularly polarized beam of radiation. Each of the radiator elements 40 and 42 are substantially identical to the radiator elements 18, above. The crossed dipole radiator elements 42 further include a series of slip joints 48 which provide for the rotation of the crossed dipole radiator elements 42 relative to the second ground plane 44.

In operation, the pyramidal feed horn 34 generates the circularly polarized beam of radiation which is received by the crossed dipole radiator elements 40. The circularly polarized beam impinges the crossed dipole radiator elements 40 and propagates through the transmission lines 46 connecting the crossed dipole radiator elements 40 and 42. After propagating through the transmission lines 46, the circularly polarized beam propagates out the crossed dipole radiator elements 42. This causes each crossed dipole radiator element 42 to radiate an individual circularly polarized beam of radiation in the same direction as the radiated beam from the pyramidal feed horn 34. The phase of each beam is similarly altered by physical rotation of the radiator elements 42 relative to the second ground plane 44 by means of the slip joints 48. The individual radiation beam from each crossed dipole radiator element 42 forms a combined radiation beam in the far field creating the predetermined radiation pattern.

Figure 7:
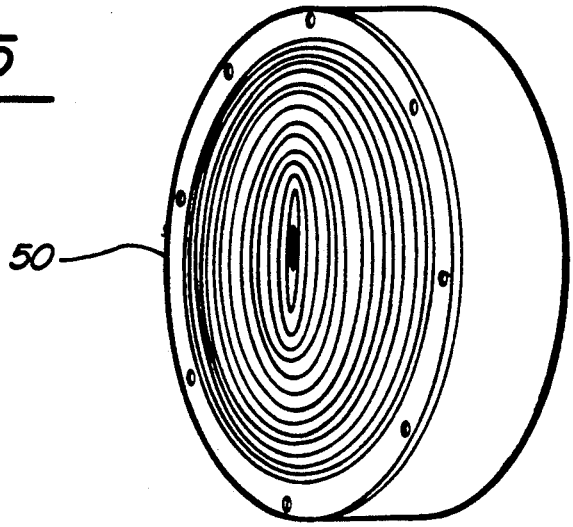
FIG. 7 is a perspective view of a spiral radiator element.
Figure 8:
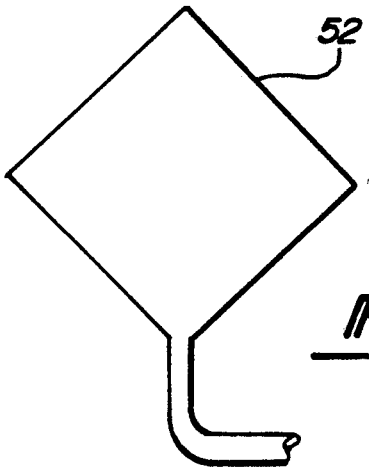
FIG. 8 is a front view of a microstrip/patch radiator element.

Referring to FIGS. 7 and 8, a spiral radiator element 50 and a microstrip/patch radiator element 52, are shown. The spiral radiator element 50 and microstrip/patch radiator element 52 can be substituted for any of the crossed dipole radiator elements 18, 40 and 42 discussed above. Each radiator element 50 and 52 is capable of radiating a circularly polarized beam of radiation and is similarly capable of altering the phase of its beam by physical rotation of the radiator element relative to a ground plane. The spiral radiator element 50 and the microstrip/patch radiator element 52 are preferably made of copper, however, radiator elements 50 and 52 can also be constructed of aluminum, graphite or other suitable electrically conductive materials. As such, one skilled in the art would readily recognize that radiator elements 50 and 52, as well as other radiator elements capable of radiating a circularly polarized beam of radiation, can be used with the beam shaping antennas discussed above.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined by the following claims.

What is claimed is:

1. A circularly polarized beam shaping antenna for shaping a beam of radiation to create a predetermined radiation pattern to radiate a fixed area such as a state, or country or continent, said circularly polarized beam shaping antenna comprising:

a circularly polarized feed horn for generating the beam of radiation;

a plurality of circularly polarized radiator elements attached to a conductive ground plane, wherein each circularly polarized radiator element is further attached to a short circuit termination through a semi-rigid coaxial cable and a balun, said circularly polarized radiator elements being positioned to receive the beam of radiation from the circularly polarized feed horn, said semi-rigid coaxial cables operable to transfer electrical signals received from each circularly polarized radiator element to the short circuit terminations, said short circuit terminations operable to reflect the electrical signals, wherein each circularly polarized radiator elements is operable to individually radiate a beam of radiation to form a combined radiation beam; and a plurality of slip joints for independently rotating the circularly polarized radiator elements to set the phase of each circularly polarized radiator element relative to the conductive ground plane, said slip joints independently altering the phase of each circularly polarized radiator element to a set phase such that the circularly polarized radiator elements shape the combined radiator beam to create the predetermined radiation pattern to radiate the fixed area.

2. The beam shaping antenna as defined in claim 1 wherein the conductive ground plane has a parabolic contour.

3. The beam shaping antenna as defined in claim 1 wherein the conductive ground plane has a planar contour.

4. The beam shaping antenna as defined in claim 1 wherein the conductive ground plane has a circumference selected from the group consisting of circular and elliptical.

5. The beam shaping antenna as defined in claim 1 wherein each circularly polarized radiator element is selected from the group of circularly polarized radiator elements consisting of a crossed dipole radiator, a spiral radiator and a microstrip/patch radiator.

6. The beam shaping antenna as defined in claim 1 wherein adjacent circularly polarized radiator elements are 180° are out of phase.

7. The beam shaping antenna as defined in claim 1 wherein the circularly polarized feed horn includes a conical feed horn.

8. The beam shaping antenna as defined in claim 1 wherein the circularly polarized feed horn includes a pyramidal feed horn.

9. A circularly polarized beam shaping antenna for shaping a beam of radiation to create a predetermined radiation pattern to radiate a fixed area such as a state, country or continent, said circularly polarized beam shaping antenna comprising:

a circularly polarized feed horn for generating the beam of radiation;

a plurality of circularly polarized radiator elements attached to a first conductive ground plane and a second conductive ground plane in conjugate pairs through a plurality of semi-rigid coaxial cables and baluns, said circularly polarized radiator elements attached to the first conductive ground plane being positioned to receive the beam of radiation from the circularly polarized feed horn, said semi-rigid coaxial cables operable to transfer an electrical signal received from each circularly polarized radiator element attached to the first conductive ground plane, wherein said circularly polarized radiator elements attached to the second conductive ground plane are operable to individually radiate a beam of radiation to form a combined radiation beam a plurality of slip joints for independently rotating only the circularly polarized radiator elements attached to the second conductive ground plane to set the phase of each circularly polarized radiator element attached to the second ground plane relative to the second conductive ground plane, said slip joints independently altering the phase of each circularly polarized radiator element attached to the second conductive ground plane such that the circularly polarized radiator elements shape the combined radiation beam to create the predetermined radiation pattern to radiate the fixed area.

10. A method of shaping a beam of radiation to create a predetermined radiation pattern to radiate a fixed area such as a state, country or continent, said method comprising the steps of:

providing a plurality of circularly polarized radiator elements attached to a conductive ground plane;

connecting a plurality of short-circuit terminations to the plurality of circularly polarized radiator elements through a plurality of semi-rigid coaxial cables and baluns;

utilizing a plurality of slip joints for rotationally adjusting each circularly polarized radiator element about an axis relative to the conductive ground plane to alter and set the phase of each circularly polarized radiator element; and illuminating the circularly polarized radiator elements such that each circularly polarized radiator element individually radiates a beam of radiation to form a combined radiation beam to create the predetermined radiation pattern to radiate the fixed area.

* * * * *